US005549789A

United States Patent [19]

Atalla et al.

[11] Patent Number: 5,549,789

[45] Date of Patent: *Aug. 27, 1996

[54] OXIDATION OF LIGNIN AND POLYSACCHARIDES MEDIATED BY POLYOXOMETALATE TREATMENT OF WOOD PULP

[75] Inventors: Rajai H. Atalla, Verona; Ira A. Weinstock, Madison, both of Wis.; Craig L. Hill, Atlanta, Ga.; Richard S. Reiner, Madison, Wis.

[73] Assignees: The United States of America as represented by the Secretary of Agriculture, Washington, D.C.; Emory University, Atlanta, Ga.

[ * ] Notice: The term of this patent shall not extend beyond the expiration date of Pat. No. 5,302,248.

[21] Appl. No.: 224,449

[22] Filed: Apr. 7, 1994

Related U.S. Application Data

[63] Continuation-in-part of Ser. No. 219,041, Mar. 28, 1994, which is a continuation-in-part of Ser. No. 937,634, Aug. 28, 1992, Pat. No. 5,302,248.

[51] Int. Cl.[6] ..... D21C 9/147; D21C 3/04

[52] U.S. Cl. ..... 162/65; 162/79; 530/506

[58] Field of Search ..... 162/65, 79, 78, 162/29; 530/500, 506; 8/107, 101, 111

[56] References Cited

U.S. PATENT DOCUMENTS

| | | | |
|---|---|---|---|
| 2,779,656 | 1/1957 | Fennel et al. | 8/106 |
| 3,657,065 | 4/1972 | Smith et al. | 162/65 |
| 4,283,301 | 8/1981 | Diehl | 252/102 |
| 4,294,703 | 10/1981 | Wilms et al. | 210/631 |
| 4,321,143 | 3/1982 | Wilms et al. | 210/631 |
| 4,486,394 | 12/1984 | Nguyen | 423/155 |
| 4,765,901 | 8/1988 | Field | 210/603 |
| 4,773,966 | 9/1988 | Huynh | 162/78 |
| 4,774,071 | 9/1988 | Jeffrey et al. | 423/573 R |
| 4,792,407 | 12/1988 | Zeff et al. | 210/748 |
| 4,839,008 | 6/1989 | Hill | 204/157.15 |
| 4,864,041 | 9/1989 | Hill | 549/513 |
| 4,892,941 | 1/1990 | Dolphin et al. | 540/145 |
| 4,931,207 | 6/1990 | Cramer et al. | 252/187.26 |
| 5,041,142 | 8/1991 | Ellis | 8/111 |
| 5,077,394 | 12/1991 | Dolphin et al. | 530/505 |

FOREIGN PATENT DOCUMENTS

| | | | |
|---|---|---|---|
| 1308096 | 9/1992 | Canada | C07C 29/48 |
| WO91/09823 | 7/1991 | WIPO | C07B 63/00 |

OTHER PUBLICATIONS

Sattari, et al., *J. Chem. Soc., Chem. Commun.*, pp. 634–635 (1990).
Chambers, et al., 30 *Inorg. Chem.*, 2776–2781 (1991).
Ishii, et al., 53 *J. J. Org. Chem.* 3587–3593 (1988).
Ali, et al., *J. Chem. Soc., Chem. Commun.*, pp. 825–826 (1989).
Lyon, et al., 113 *J. Am. Chem. Soc.* 7209–7221 (1991).
Mansuy, et al., 113 *J. Am. Chem. Soc.* 7222–7226 (1991).
Chambers, et al., 28 *Inorg. Chem.* 2509–2511 (1989).

(List continued on next page.)

*Primary Examiner*—Donald E. Czaja
*Assistant Examiner*—Dean T. Nguyen
*Attorney, Agent, or Firm*—Janet I. Stockhausen; M. Howard Silverstein; John D. Fado

[57] ABSTRACT

A method for oxidative degradation of lignin and polysaccharide fragments dissolved during polyoxometalate delignification or bleaching of wood pulp, wood fiber or pulp obtained from a non-woody plant. The method comprises the steps of obtaining a spent polyoxometalate bleaching solution containing a polyoxometalate of the formula $[V_l Mo_m W_n Nb_o Ta_p (TM)_q X_r O_s]^{x-}$ where 1 is 0–18, m is 0–40, n is 0–40, o is 0–10, p is 0–10, q is 0–9, r is 0–6, TM is a d-electron-containing transition metal ion, and X is a heteroatom which is p or d block element, provided that $l+m+n+o+p \geqq 4$, $l+m+q>0$ and s is sufficiently large that $x>0$, and heating the solution in the presence of an oxidant under conditions wherein the dissolved organic compounds are oxidatively degraded to volatile organic compounds and water.

20 Claims, 3 Drawing Sheets

OTHER PUBLICATIONS

Venturello, et al., 51 *J. Org. Chem.* 1599–1602 (1986).
Deutsch, et al., 62 *TAPPI* 53–55 (1979).
Hill, et al., 108 *J. Am. Chem. Soc.* 536–538 (1986).
Finke, et al., 26 *Inorg. Chem.* 3886–3896 (1987).
Khenkin, et al., in *The Activation of Dioxygen and Homogeneous Catalytic Oxidation,* Barton, et al. (eds.), Plenum Press, New York, 463 (1993).
Gómez–Garcia, et al., 32 *Inorg. Chem.* 3378–3381 (1993).
Tourné, et al., *J. Chem. Soc. Dalton Trans.,* pp. 143–155 (1991).
Creaser, et al., 32 *Inorg. Chem.* 1573–1578 (1993).
Tourné, et al., 32 *J. Inorg. Nucl. Chem.* 3875–3890 (1970).
Weinstock, et al., *Proc. TAPPI Pulping Conf.,* pp. 519–532 (Nov. 1993).
Khenkin, et al., *Mendeleev Commun.,* pp. 140–141 (1993).
Smith, et al., *Svensk Papperstidning,* No. 1223, pp. R106–R112 (1985).
Atalla, "The Polyoxometalates: New Bleaching Systems For The 21st Century", Abstract Drafted for Mar. 2, 1994 Talk at TAPPI Annual Meeting.
Tolman, et al., "The Destruction . . . $H_2O_2/Fe^{++}/UV/O_2$", in *The Activation of Dioxygen and Homogeneous Catalytic Oxidation,* Barton, et al. (eds), pp. 57–70, Plenum Press, New York (1993).
Teletzke, et al., 24 *Proc. Indus Waste Conf.* 1195–1200 (1969).
Brett, et al., 23 *J. Appl. Chem. Biotechnol.* 239–250 (1973).
Mohlman, et al., 3 *Indus. & Engin. Chem.* 119–123 (1931).
Moore, et al., 21 *Anal. Chem.* 953–957 (1949).
Moore, et al., 23 *Anal. Chem.* 1297–1300 (1951).
Dobbs, et al., 35 *Anal. Chem.* 1064–1067 (1963).
*Standard Methods for the Examination of Water and Wastewater,* Franson (ed), American Public Health Assn., pp. 506–538 (1985).
Tsigdinos, et al., 7 *Inorg. Chem.* 437–441 (1968).
Kozhevnikov, et al., 51 *Russian Chem. Rev.* 1075–1088 (1982).

OXIDATION OF LIGNIN AND POLYSACCHARIDES MEDIATED BY POLYOXOMETALATE TREATMENT OF WOOD PULP

RELATED APPLICATIONS

This application is a continuation-in-part of U.S. Ser. No. 08/219,041, filed on Mar. 28, 1994, entitled OXIDATIVE DELIGNIFICATION OF WOOD OR WOOD PULP BY TRANSITION METZ-SUBSTITUTED POLYOXOMETALATES with inventors I. A. Weinstock and C. L. Hill which is a continuation-in-part of application Ser. No. 07/937,634, filed Aug. 28, 1992, now U.S. Pat. No. 5,302,248. Both of these applications are incorporated by reference as if set forth below.

FIELD OF THE INVENTION

The field of the present invention in general is the use of transition metal-derived agents in the oxidative degradation of water soluble kraft lignin and polysaccharide fragments. Specifically, the field of the present invention is the use of polyoxometalates and oxygen in the oxidative degradation of kraft lignin and polysaccharide fragments solubilized during polyoxometalate delignification or bleaching of wood or wood pulp.

BACKGROUND OF THE INVENTION

Pulping. The transition of a tree into paper involves several discrete stages. Stage one is the debarking of the tree and the conversion of the tree into wood chips. Stage two is the conversion of wood chips into pulp. This conversion may be by either mechanical or chemical means.

Bleaching. Bleaching is the third stage. Delignification is the first step in the bleaching of chemical pulps. Lignin, a complex polymer derived from aromatic alcohols, is one of the main constituents of wood. During the early stages of bleaching, residual lignin, which constitutes 3–6% of the pulp, is removed. Currently, this is typically done by treatment of the pulp with elemental chlorine at low pH, followed by extraction with hot alkali. Once a significant portion of the residual lignin has been removed, the pulp may be whitened, by a variety of means, to high brightness. Chlorine dioxide is commonly used in the brightening step.

Although chlorine compounds are effective and relatively inexpensive, their use in pulp mills results in the generation and release of chlorinated organic materials, including dioxins, into rivers and streams. Due to increasing regulatory pressures and consumer demand, new, non-chlorine bleaching technologies are urgently needed by manufacturers of paper-grade chemical pulps.

Chlorine-Free Bleaching using Polyoxometalates.

Polyoxometalates are discrete polymeric structures that form spontaneously when simple oxides of vanadium, niobium, tantalum, molybdenum or tungsten are combined under the appropriate conditions in water (Pope, M. T. *Heteropoly and Isopoly Oxometalates* Springer-Verlag, Berlin, 1983). In a great majority of polyoxometalates, the transition metals are in the $d^0$ electronic configuration which dictates both high resistance to oxidative degradation and an ability to oxidize other materials such as lignin. The principal transition metal ions that form polyoxometalates are tungsten(VI), molybdenum(VI), vanadium(V), niobium(V) and tantalum(V).

Isopolyoxometalates, the simplest of the polyoxometalates, are binary oxides of the formula $[M_mO_y]^{p-}$, where m may vary from two to over 30. For example, if m= 2 and M= Mo, then the formula is $[Mo_2O_7]^{2-}$; if m=6, then $[Mo_6O_{19}]^{2-}$; and if m=36, then $[Mo_{36}O_{112}]^{8-}$. Polyoxometalates, in either acid or salt forms, are water soluble and highly resistant to oxidative degradation.

Heteropolyoxometalates have the general formula $[X_xM_mO_y]^{p-}$ and possess a heteroatom, X, at their center. For example, in the α-Keggin structure, α-$[PW_{12}O_{40}]^{3-}$, X is a phosphorus atom. The central phosphorus atom is surrounded by twelve $WO_6$ octahedra.

Removal of a $(M{=}O)^{4+}$ moiety from the surface of the α-Keggin structure α-$[PM_{12}O_{40}]^{3-}$ where M is molybdenum or tungsten, creates the "lacunary" α-Keggin anion, α-$[PM_{11}O_{39}]^{7-}$. The lacunary α-Keggin ion acts as a pentadentate ligand for redox active transition-metal ions, such as vanadium(V) in α-$[PVW_{11}O_{40}]^{4-}$. Further substitution is also possible, giving anions of the form $[X_xM'_mM_nO_y]^{p-}$, such as α-$[PV_2Mo_{10}O_{40}]^{5-}$. In place of vanadium(V), d-electron-containing redox active transition-metal ions (TM), may also be used, giving complexes such as α-$[SiMn(III)(H_2O)W_{11}O_{39}]^{5-}$,which contains a manganese(III) ion. While stabilizing the active metal ions in solution and controlling their reactivity, the heteropolyanions are highly resistant to oxidative degradation (Hill, et al., *J. Am. Chem. Soc.* 108:536–538, 1986).

Effluent Free Mill. During delignification or bleaching, whether by chlorine, chlorine dioxide, oxygen, hydrogen peroxide, ozone, or other methods, lignin and polysaccharide fragments are liberated as water-soluble organic compounds. After delignification or bleaching, these compounds remain dissolved in the liquor. At present, water soluble lignin and polysaccharide fragments removed from wood pulps during bleaching are generally treated in biological waste-treatment ponds prior to their release to rivers and streams. Unfortunately, biological remediation fails to remove or to sufficiently degrade all of the dissolved organic materials present. As a result, potentially harmful organic compounds, particularly those generated during chlorine bleaching, are released into the environment. Because some of the materials that survive the biological waste treatment may have deleterious environmental effects, there is a need for alternative and more effective methods for degrading these materials.

Many in the U.S. pulp and paper industry expect that the release of any organic waste (other than carbon dioxide) into the environment will eventually be banned altogether. There is thus an additional need for the development of a "closed" bleach mill from which few or no chemical waste-products, other than carbon dioxide and water, are released (Pulp and Paper Mill of the Future—An Information Exchange, U.S. Department of Energy, Office of Industrial Technologies, Orono, Me., September 8–10, 1993). As disclosed below, polyoxometalates are employed as reusable oxidizing agents or catalysts for selective bleaching of wood pulps. As reusable agents, the polyoxometalates are suitable for repeated use in a closed mill. During polyoxometalate bleaching, however, residual kraft lignin fragments, and some polysaccharide fragments, are dissolved by the polyoxometalate bleaching liquor.

What is needed in the art of polyoxometalate bleaching is a method for achieving mill closure by removing dissolved lignin and polysaccharide fragments from the bleaching liquor.

SUMMARY OF THE INVENTION

In the present invention vanadium(+4 or +5)-substituted, molybdenum(+5 or +6)-substituted, and other transition metal-substituted polyoxometalates are used as catalysts in the oxidative degradation of kraft lignin and polysaccharide fragments solubilized during polyoxometalate bleaching of wood pulp.

The general formula for a polyoxometalate useful in the present invention is $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom which is a p or d block element, provided that $l+m+n+o+p \geqq 4$, $l+m+q>0$, and s is sufficiently large that $x>0$. The present invention is a method of oxidatively degrading dissolved lignin and polysaccharide fragments comprising the first steps of obtaining a pulp, and exposing the pulp to a polyoxometalate of the preferred formula, wherein the polyoxometalate is reduced and the lignin and polysaccharide fragments within the pulp are dissolved. The reduced polyoxometalate bleaching liquor is exposed to an oxidant under conditions wherein the dissolved lignin and polysaccharide fragments are oxidatively degraded. Preferably, the polyoxometalate is oxidized and the resultant liquor is thus available for reuse in bleaching.

The present invention is also a method of using a polyoxometalate of the general formula as a catalyst in the oxidative degradation of lignin and polysaccharide fragments solubilized during polyoxometalate delignification or bleaching of wood fibers. The present invention is also a method of oxidatively degrading dissolved lignin and polysaccharide fragments solubilized during polyoxometalate delignification or bleaching of pulp obtained from other lignocellulosic materials.

Preferably, the bleaching liquor contains a polyoxometalate of the formula $[V_lMO_mW_n(TM)_oX_pO_q]^{x-}$, where TM is any d-electron-containing transition metal ion, and X is a heteroatom which is a p or d block element, and either $l+m+n+o=12$ and $p=1$; or where $l+m+n+o=22$, $1+o$ is 1–4 and $p=2$; or where X is either $p^{5+}$, $As^{5+}$ or $S^{6+}$, and $l+m+n+o=18$, $o \leqq 6$, $p=2$ and $l+m+o>0$; or where $m+n=30$, $p=4$ and $o=4$, and wherein 9 is sufficiently large that $x>0$.

Also preferably, the wood pulp is exposed to a polyoxometalate of the formula $[V_lMO_mW_n(TM)_oP_5C_pNa_qO_r]^{x-}$, where TM is any d-electron-containing transition metal ion, C is a di- or tri-valent p, d or f block cation located in the center of the structure, $l+m+n+o=30$, $p+q=1$ and $l+m+o>0$.

Other preferable forms of polyoxometalates include polyoxometalates of the formula $[V_nO_r]^{x-}$, where $n \geqq 4$, $r \geqq 12$ and $x=2r-5n$, or $[V_nMo_mW_o(MG)_p(TM)_qO_r]^{x-}$ where TM is any transition metal ion, MG is a main group ion, $1 \leqq n \leqq 8$, $n+m+o \leqq 12$ and $p+q \leqq 4$, or $[V_nMO_mW_o(MG)_pO_r]^{x-}$ where MG is either $P^{5+}$, $As^{5+}$, $S^{6+}$, $1 \leqq n \leqq 9$, $n+m+o=18$ and $p=2$.

In the general and preferred formulas mentioned in U.S. Ser. No. 07/937,634 now U.S. Pat. No. 5,302,248, heteroatoms are represented by the symbol "MG", where MG is a main group element. However, a number of useful polyoxometalates contain heteroatoms that are ions of d block, rather than main group, elements. To include these cases, the symbol "X" is used in the present invention to represent a heteroatom that is either a p (main group) or d block element.

Preferably, the dissolved lignin and polysaccharide fragments are oxidatively degraded with air or oxygen. Nonetheless, other, more expensive oxidants suitable for the present invention include hydrogen peroxide and other organic or inorganic peroxides (free acid or salt forms), or ozone. All these oxidants are more environmentally friendly than chlorine compounds.

It is an object of the present invention to oxidatively degrade dissolved lignin and polysaccharide fragments derived from hardwood and softwood pulp. It is another object of the present invention to oxidatively degrade dissolved lignin and polysaccharide fragments derived wood fiber. It is another object of the present invention to oxidatively degrade dissolved lignin and polysaccharide fragments derived from pulp obtained from non-woody plants.

It is an object of the present invention to oxidatively degrade dissolved lignin and polysaccharide fragments to isolable low molecular weight compounds. Preferably, the degradation results in volatile organic materials, including carbon dioxide, and water.

It is a feature of the present invention that the oxidative degradation of dissolved lignin and polysaccharide fragments may be carried out prior to, simultaneously with, or after oxidative regeneration of the polyoxometalate bleaching agent.

Other features, objects and advantages of the present invention will become apparent upon examination of the specification, claims and drawings.

DESCRIPTION OF THE FIGURES

FIG. 1*a* is a Keggin structure, $[XW_{12}O_{40}]^{x-}$ (the charge, x, depends on the heteroatom, X, shown in dark shading in the center of the structure). A transition metal-substituted Keggin anion is obtained when one of the twelve tungsten atoms is replaced by a d-electron-containing transition metal ion. FIG. 1*b* is a trivacant Keggin derived sandwich complex, $[(M^{II})_2(M^{II}L)_2(PW_9O_{34})_2]^{10-}$ and FIG. 1*c* is a trivacant Wells-Dawson derived sandwich complex, $[(M^{II})_2(M^{II}L)_2(P_2W_{15}O_{56})_2]^{16-}$, where M represent d-electron-containing transition metal ions (dark shaded octahedra) and L is an exchangeable ligand.

BRIEF DESCRIPTION OF THE INVENTION

Figure 1A:
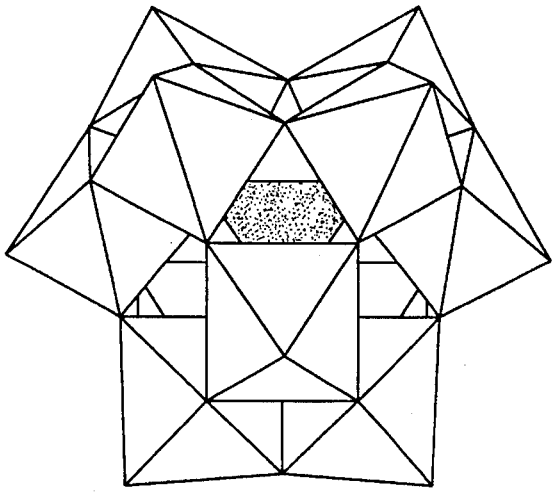
FIG. 1A–1C are polyhedral illustration of three representative polyoxometalates. The light shaded octahedra are $W^{VI}$ ions and each polyhedron vertex is an O atom. Tetrahedral $XO_4$ units, where X is a main group or transition metal ion, are internal to all 3 structures.

The present invention is a method for oxidatively degrading lignin and polysaccharide fragments, dissolved during polyoxometalate delignification or bleaching of wood fibers or wood pulp, to volatile organic compounds and water.

The parent applications (Ser. No. 07/937,634 now U.S. Pat. No. 5,302,248 and Ser. No. 08/219,041, filed Mar. 28, 1994, entitled OXIDATIVE DELIGNIFICATION OF WOOD OR WOOD PULP BY TRANSITION METAL-SUBSTITUTED POLYOXOMETALATES) describe a method for using polyoxometalates to remove substantial quantities of residual lignin from pulp. As such, the polyoxometalates are an effective alternative to chlorine and play a similar role in the bleaching process. Preferably, the polyoxometalates are used in combination with a chlorine-free oxidant selected from the group consisting of air, oxygen, hydrogen peroxide and other organic or inorganic peroxides (free acid or salt forms), or ozone.

In General

The first step in one embodiment of the present invention is the production of a wood pulp. Wood pulps may be produced by any conventional method, including both kraft and non-kraft pulps. Suitable pulp production methods are described in "Pulp and Paper Manufacture," 2nd Edition, Volume I, *The Pulping of Wood,* R. G. Macdonald and J. N. Franklin Eds., McGraw-Hill Book Company, New York, 1969.

Wood pulps are generally divided into softwood pulps (e.g., pine pulps) and hardwood pulps (e.g., aspen pulps). Softwood pulp is the most difficult to delignify because lignin is more abundant in softwoods than in hardwoods. Due to structural differences, largely attributable to the lower average number of methoxy groups per phenyl ring, softwood lignin is less susceptible to oxidative degradation. The Examples below describe the efficiency of the method of the present invention with softwood kraft pulp. However, the present invention is suitable for delignification of hardwood pulps also.

In another embodiment, the present invention starts with the preparation of wood fiber by primarily mechanical, rather than chemical, means. Mechanical fibers may be prepared from hardwoods or softwoods by a number of mechanical refining processes. Mechanical pulps are most commonly produced by: grinding (groundwood pulp), refining at elevated temperatures (thermomechanical pulp, TMP) and refining at elevated temperatures after an initial chemical treatment (chemothermomechanical pulp, CTMP). Steam explosion or other physical methods might also be used, but are less common. Ser. No. 07/937,634 now U.S. Pat. No. 5,302,248 and Ser. No. 08/219,041, filed Mar. 28, 1994, entitled OXIDATIVE DELIGNIFICATION OF WOOD OR WOOD PULP BY TRANSITION METAL-SUBSTITUTED POLYOXOMETALATES, demonstrate the effectiveness of polyoxometalates of the general formula in the delignification of wood fibers.

Another class of pulps for which the present invention is suitable is that derived from non-woody plants such as sugar cane, kenaf, esparto grass, and straw, as well as plants producing bast fibers. The lignocellulosic constituents of such plants are usually susceptible to the same pulping methods as are applicable to wood, though in many instances they require less severe conditions than wood. The resulting pulps are usually less difficult to delignify or bleach than are those derived from softwoods by the kraft process.

Polyoxometalate bleaching system

The next step of the present invention is the exposure of the pulp to a polyoxometalate. Polyoxometalates suitable for the present invention may be applied as stoichiometric oxidants, much as chlorine and chlorine dioxide are currently. The general formula of the preferred polyoxometalate is $[V_lMo_mW_nNb_oTa_p(TM)_qX_r\ O_s]^{x-}$ where l is 0–18, m is 0–40, n is 0–40, o is 0–10, p is 0–10, q is 0–9 r is 0–6, TM is a d-electron-containing transition metal ion, and X is a heteroatom, which is a p or d block element, provided that $l+m+n+o+p \geqq 4$, $l+m+q>0$, and s is sufficiently large that $x>0$. X is typically $Zn^{2+}$, $Co^{2+}$, $B^{3+}$, $Al^{3+}$, $Si^{4+}$, $Ge^{4+}$, $P^{5+}$, $As^{5+}$, or $S^{6+}$.

Preferably, the polyoxometalate used in the present invention is one of five different formulas that are subsets of the general formula:

Formula 1, the transition metal-substituted Keggin structure, is $[V_lMo_mW_n(TM)_oX_pO_q]^{x-}$, where TM is any d-electron-containing transition metal ion, X is a heteroatom, which is a p or d block element, $l+m+n+o=12$, $p=1$, $o \leqq 4$ and $l+m+o>0$, and wherein q is sufficiently large that $x>0$. $\alpha$-$K_5[SiMn(III)(H_2O)W_{11}O_{39}]$ is an example of a potassium salt of this structure.

Formula 2, the trivacant Keggin derived sandwich complex, is $[V_lMo_mW_n(TM)_oX_pO_q]^{x-}$, where TM is any d-electron-containing transition metal ion, X is a heteroatom, which is a p or d block element, $l+m+n+o=22$, $1+o$ is 1–4 and $p=2$, and wherein q is sufficiently large that $x>0$.

Formula 3, the transition metal-substituted Wells-Dawson structure, is $[V_lMo_mW_n(TM)_oX_pO_q]^{x-}$, where TM is any d-electron-containing transition metal ion, X is either $P^{5+}$, $As^{5+}$, or $S^{6+}$, $l+m+n+o=18$, $o \leqq 6$, $p=2$ and $l+m+o>0$, and wherein q is sufficiently large that $x>0$.

Formula 4, the trivacant Wells-Dawson derived sandwich complex, is $[Mo_mW_n(TM)_4X_pO_q]^{x-}$, where TM is any d-electron-containing transition metal ion, X is either $P^{5+}$, $As^{5+}$ or $S^{6+}$, $m+n=30$ and $p=4$, and wherein q is sufficiently large that $x>0$.

Formula 5, the transition metal-substituted Preyssler structure, is $[V_lMo_mW_n(TM)_oP_5C_pNa_qO_r]^{x-}$, where TM is any d-electron-containing transition metal ion, C is a di- or tri-valent d, p, or f block cation located in the center of the structure, $l+m+n+o=30$, $p+q=1$ and $l+m+o>0$, and wherein r is sufficiently large that $x>0$.

The following formulas for vanadium-containing polyoxometalates (Formulas 6–8) were disclosed in U.S. Ser. No. 07/937,634 now U.S. Pat. No. 5,302,248 as suitable for the pulping method. The formulas are all subsets of the general formula and are also preferred for the methods of the present invention. More specifically, Formulas 7 and 8 are subsets, respectively, of Formulas 1 and 3.

Formula 6, an isopolyvanadate, is $[V_nO_r]^{x-}$, where $n \geqq 4$, $r \geqq 12$ and $x=2r-5n$. $Na_6[V_{10}O_{28}]$ is an example of a sodium salt of a polyoxometalate of this formula.

Formula 7, the Keggin structure, is $[V_nMo_mW_o(MG)_p(TM)_qO_r]^{x-}$, where TM is any transition metal, MG is a main group ion, $1 \leqq n \leqq 8$, $n+m+o \leqq 12$ and $p+q \leqq 4$. $H_5[PV_2Mo_{10}O_{40}]$, compound 1, is an example of an acid of this formula. $Na_4[PVW_{11}O_{40}]$ is an example of a sodium salt.

Formula 8, the Wells-Dawson structure, is $[V_nMo_mW_o(MG)_pO_r]^{x-}$ where MG is either $P^{5+}$, $As^{5+}$, or $S^{6+}$, $1 \leqq n \leqq 9$, $n+m+o=18$, and $p=2$. $H_9[P_2V_3W_{15}O_{62}]$ is an example of an acid of this structure.

A common feature of the structures described in the formulas above is the presence of a vanadium ion in its +5 $d^0$ electronic configuration, of a molybdenum ion in its +6 $d^0$ electronic configuration or of a d-electron-containing transition metal ion capable of reversible oxidation and that in one of its oxidation states is sufficiently active so as to oxidatively degrade lignin. In combination with chlorine-free oxidants such as oxygen, peroxides or ozone, complexes of this type oxidize functional groups within lignin, leading to delignification and bleaching. This can occur via direct lignin oxidation by a vanadium(+5) or molybdenum(+6) ion, or by the d-electron-containing transition metal ion, leading to reversible reduction of the vanadium, molybdenum, or d-electron-containing transition metal ion. In a subsequent step, the reduced polyoxometalate bleaching agent is regenerated to its active form by reaction with the chlorine-free oxidant. Alternatively, the polyoxometalate complex can react with pulp in the presence of the chlorine-free oxidant. In either case, it is essential that a d-electron-containing transition metal, vanadium(+5), or molybdenum(+6) ion be present in the polyoxometalate structure.

The structures defined by the above formulas are all logical candidates .for use in bleaching with chlorine-free oxidants because they all possess either d-electron-containing transition metal, vanadium(+5) or molybdenum(+6) ions.

A compound of Formula 7 a subset of Formula 1, (a phosphomolybdovanadate, $\alpha$-$H_5[PV_2Mo_{10}O_{40}]$, compound 1) was chosen for the Examples given below because it is one of the most thoroughly studied and simplest to prepare (Kozhevnikov, I. V., et al., *Russian Chemical Reviews,* 51:1075–1088, 1982). Using $^{31}P$ nuclear magnetic resonance (NMR) spectroscopy (see Examples), we have observed that this compound, prepared according to the most widely cited procedure and originally described as having the composition $H_5[PV_2Mo_{1.}O_{40}]$ (Tsigdinos, G. A., et al., *Inorganic Chemistry,* 7:437–441, 1968), is actually a mixture of $H_4[PV_lMo_{11}O_{40}]$, $H_5[PV_2Mo_{10}O_{40}]$ and $H_6[PV_3Mo_9O_{40}]$, the latter two existing as mixtures of positional isomers, all still of Formula 1. In the present invention, Compound 1 will thus refer to mixtures of these three compounds.

Compounds of Formula 2 are sandwich complexes derived from trivacant derivatives of those defined by Formula 1 (Finke, R. G., et al., *Inorganic Chemistry,* 26:3886–3896, 1987; Khenkin, A. M., et al., in The Activation of Dioxygen and Homogeneous Catalytic Oxidation, Barton, D. H. R., ed., Plenum Press, New York, 1993, 463; Gómez-García, C. J., et al., *Inorganic Chemistry,* 32:3378–3381, 1993, Tourné, G. F., et. al., *J. Chem. Soc., Dalton Trans.,* 143–155, 1991). Some of these derivatives, whether vanadium(+5) or d-electron-containing transition metal-substituted, are particularly well-suited for use in bleaching because they exhibit remarkably high selectivities and possess extremely high stabilities.

Compounds of Formula 3 are structurally closely analogous to those of Formula 1, very similar in reactivity, and significantly more stable (Lyon, D. K., et al., *J. Am. Chem. Soc.,* 113:7209–7221, 1991; Finke, R. G., et al, *J. Am. Chem. Soc.,* 108:2947–2960, 1986). Compounds of Formula 4 are sandwich complexes formed from trivacant derivatives of those defined by Formula 3 (Finke, R. G., et al., *Inorganic Chemistry,* 26:3886–3896, 1987; Khenkin, A. M., et al., in The Activation of Dioxygen and Homogeneous Catalytic Oxidation, Barton, D. H. R., ed., Plenum Press, New York, 1993, 463).

In the case of Formula 5, a number of main group-ion and lanthanide-ion derivatives, and two vanadium-ion-substituted structures, have been prepared and characterized (Creaser, I., et al., *Inorganic Chemistry,* 32:1573–1578, 1993). The vanadium-substituted structures contain vanadium(+4) or vanadium(+5) in place of one of the structural tungsten atoms. Based on the reported potential of the redox couple involving these vanadium(+5) and vanadium(+4) substituted polyoxometalates, the vanadium(+5) compound would clearly be useful in delignification and bleaching (Alizadeh, et al., *J. Am. Chem. Soc.,* 107:2662–2669, 1985). By analogy with the well-established syntheses of structures of Formulas 1 and 3, it is logical that, in addition to vanadium(+5), molybdenum(+6) or d-electron-containing transition metal ions could also be substituted in place of a structural tungsten atom. Based on the criteria outlined immediately following the introduction of Formulas 1–8 above, these complexes would be effective in bleaching. Such derivatives of Formula 5 are likely to be extremely stable and thus particularly useful for commercial applications.

Figure 1C:
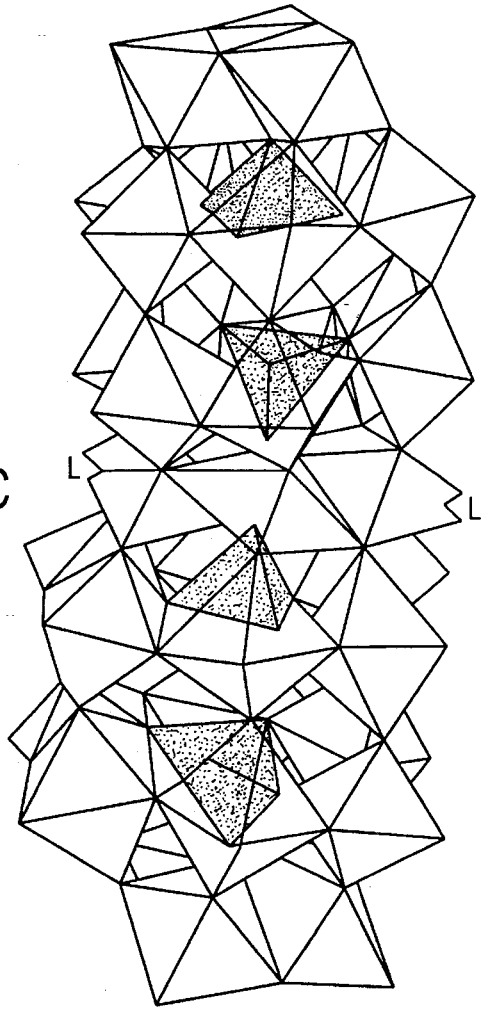
Figure 1B:
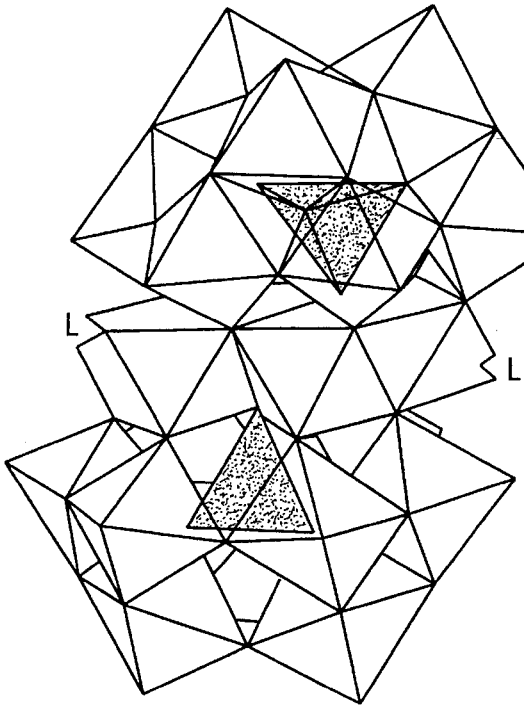

FIG. 1. is a polyhedral illustration of three representative polyoxometalates of the formulas $[XW_{12}O_{40}]^{X-}$, [(M) (M L)(PW O)], and [(M)(M L)(P W O)].

Polyoxometalate salts are generally water soluble (hydrophilic). However, hydrophobic forms can be made easily and are suitable for use in selective bleaching with solvents other than water. Some cations suitable for formation of hydrophobic forms are defined in U.S. Pat. No. 4,864,041 (inventor: Craig L. Hill).

The polyoxometalate of the present invention is typically in an acid, salt or acid-salt form. For example, compound 1 when neutralized to a pH of 3 or above (see Examples) is in salt form (Tsigdinos, G. A., et al., *Inorganic Chemistry,* 7:437–441, 1968). Suitable cations for salt formation are $Li^+$, $Na^+$, $K^+$, $Cs^+$, $NH_4^+$ and $(CH_3)_4N^+$ which may be replaced in part (acid-salt form) or in full (acid form) by protons (H+). The listed cations are sensible choices, but there are others that are available and cost effective.

Figure 2:
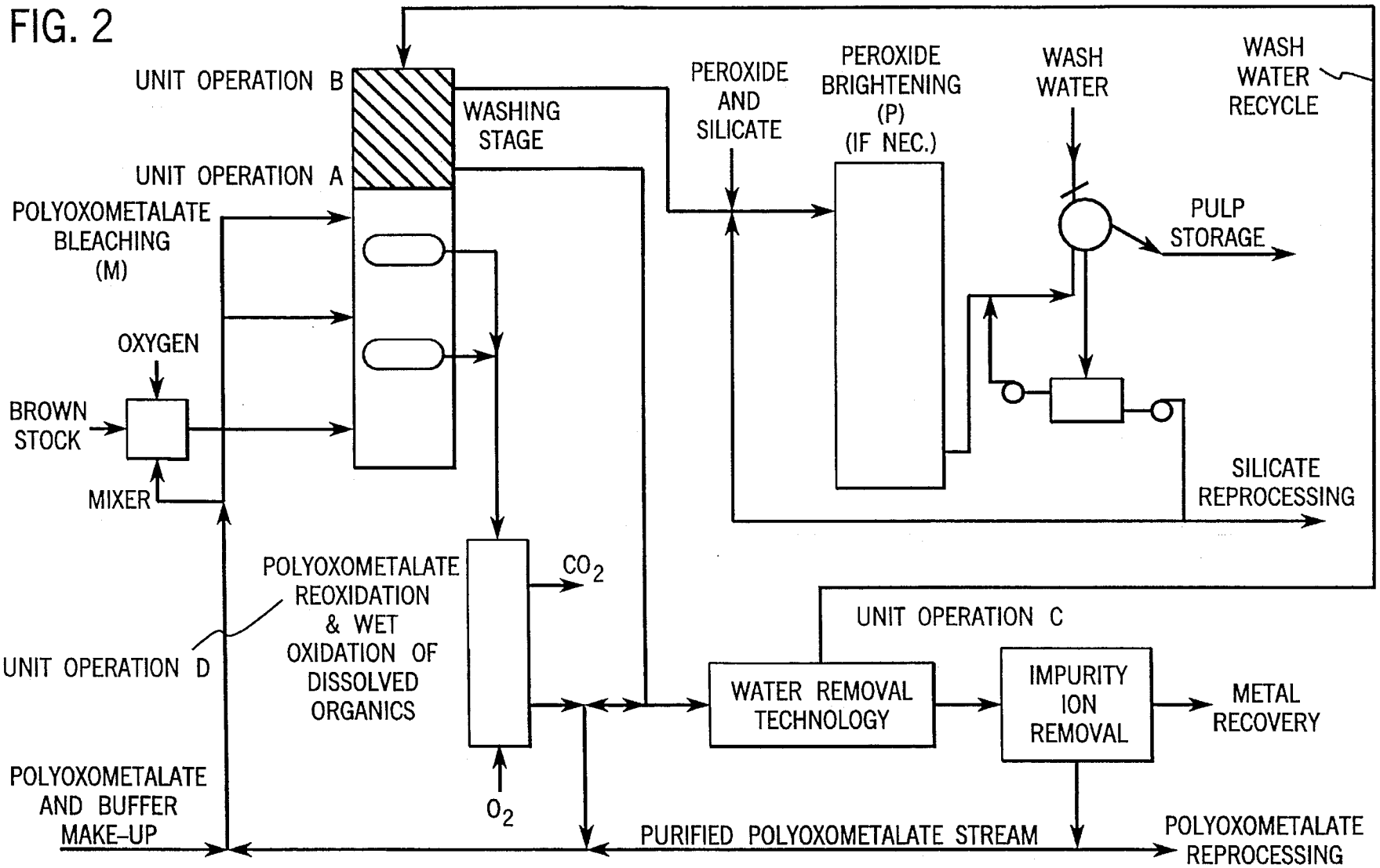
FIG. 2 is a flow diagram for a closed mill polyoxometalate bleaching process including a bleaching reactor (Unit Operation A) and a reactor for wet oxidation of organics and oxidative regeneration of polyoxometalate bleaching agents (Unit Operation D).

Closed mill polyoxometalate bleaching process. A flow diagram of a typical, preferred polyoxometalate bleaching process is shown in FIG. 2. Unbleached kraft pulp, referred to as brownstock, is exposed to an aqueous polyoxometalate bleaching liquor (Unit Operation A) according to the methods described in the parent applications, Ser. No. 07/937,634 now U.S. Pat. No. 5,302,248 and Ser. No. 08/219,041, filed Mar. 28, 1994 and entitled OXIDATIVE DELIGNIFICATION OF WOOD OR WOOD PULP BY TRANSITION METAL-SUBSTITUTED POLYOXOMETALATES. In bleaching, polyoxometalates are applied as stoichiometric oxidants, much as chlorine and chlorine dioxide are currently. Polyoxometalates suitable for the present invention include all those suggested for use in bleaching. For wet oxidation, however, these polyoxometalates may either be in their fully oxidized or reversibly reduced forms. The bleaching and wet oxidation processes are described in more detail below.

During the bleaching reaction (Unit Operation A), residual lignin fragments and some polysaccharide fragments are solubilized and remain in the reduced (spent) bleaching liquor.

After leaving the bleaching reactor, the pulp is concentrated to a preferable consistency of 30%, removing approximately 95% of the polyoxometalate laden liquor. The pulp then passes to a washing stage (Unit Operation B). Although a washer is indicated in FIG. 2, high efficiency washers, such as belt washers, may be preferable. Preliminary washing studies demonstrate that the polyoxometalates are not adsorbed onto pulp fibers. This is a critically important result. It means that, unlike removal of caustic, removal of polyoxometalate from the pulp is controlled by diffusion phenomena alone, and that there is no adsorption limit. The polyoxometalates are negatively charged ions that should not normally bind to cellulose, which is also negatively charged.

Still referring to FIG. 2, the wash water might be recycled by evaporation using heat provided by low grade steam. The concentrated liquor is then treated by a separation technology (Unit Operation C) to remove inorganic salts, such as those of manganese, iron and calcium, carried in with the pulp. Several separation technologies, using crystallization, ion-exchange columns or selective membranes may be appropriate here (McCabe, W. L., et al., *Unit Operations of Chemical Engineering,* McGraw-Hill, New York, 1985). We anticipate that some polyoxometalate will be removed at this or a separate point and re-refined.

Still referring to FIG. 2, the spent liquor from both the reactor and evaporators, still containing polysaccharide and lignin fragments previously associated with the pulp, is then passed to a regeneration unit (Unit Operation D). The purpose of this Unit Operation is two-fold: to oxidatively degrade dissolved lignin and polysaccharide fragments to volatile organic materials, carbon dioxide, and water (wet oxidation of the dissolved organic compounds), and to reoxidize the polyoxometalate to its active form. Although the polyoxometalates act with high selectivity in the bleaching reaction with pulp, the conditions in the wet oxidation unit will be significantly more aggressive. Under these conditions, the polyoxometalates act as catalysts for, and initiators of, the aerobic oxidation and autoxidation of dissolved organic materials. This is where the remarkable thermal stability and resistance to oxidative degradation of the polyoxometalates are used to their fullest advantage. The polyoxometalates are stable under conditions wherein even very robust synthetic metalloporphyrins (Dolphin, D. H., et al., U.S. Pat. Nos. 4,892,941 and 5,077,394) are susceptible to oxidative degradation.

Preferably, the oxidant used in the polyoxometalate catalyzed wet oxidation step will be air or oxygen. Unlike degradative systems which use metalloporphyrins (Dolphin, D. H., et al., U.S. Pat. Nos. 4,892,941 and 5,077,394) or simple transition metal salts or complexes (Huynh, V. B., U.S. Pat. No. 4,773,966; Waldmann, H., U.S. Pat. Nos. 4,321,143 and 4,294,703) which require the addition of costly organic or inorganic peroxides, extensive oxidative degradation of dissolved organic materials is achieved in the present invention using oxygen alone. Nonetheless, any chlorine-free oxidant selected from the group consisting of air, oxygen, hydrogen peroxide and other organic or inorganic peroxides (free acid or, i.e. peracids salt forms), or ozone might be useful in the present invention. For example, small amounts of ozone might be used at the end of wet oxidation to augment the catalytic oxygen treatment or to ensure complete polyoxometalate oxidation. An advantage of the polyoxometalates when compared to metalloporphyrins or other transition-metal complexes or salts, is that the polyoxometalates are uniquely stable to oxidative degradation under strongly oxidizing conditions, which include exposure to ozone.

Relationship Between Wet Oxidation and Polyoxometalate Regeneration. Polyoxometalate treatment involves two steps: Polyoxometalate bleaching, here described as Unit Operation A, and oxidative regeneration of the reduced polyoxometalates, here referred to as Unit Operation D. In the first step (eq. 1, Unit Operation A), mixtures of water, pulp and a fully oxidized polyoxometalate ($P_{ox}$), are heated. During the reaction, the polyoxometalate is reduced, as the lignin-derived material within the pulp is oxidized. At the same time, lignin fragments and some polysaccharide fragments are released from the pulp and solubilized by the polyoxometalate bleaching liquor.

Before it can be used again, the reduced polyoxometalate ($P_{red}$) must be re-oxidized. This is done by treating the polyoxometalate solution with chlorine-free oxidants such as air, oxygen, hydrogen peroxide and other organic or inorganic peroxides (free acid or salt forms), or ozone (eq. 2).

$$\text{Pulp}+P_{ox}\rightarrow\text{Bleached Pulp}+P_{red} \quad (1)$$

$$P_{red}+O_2+4H^+\rightarrow P_{ox}+2H_2O \quad (2)$$

The present application further expands Unit Operation D to include the use of polyoxometalates to catalyze the oxidative degradation (wet oxidation) of dissolved lignin and polysaccharide fragments either prior to, simultaneously with, or after the second step (eq. 2). The object here is not only the oxidative regeneration of the polyoxometalate to its bleaching-active form, but, in addition, the polyoxometalate catalyzed oxidative degradation (wet oxidation) of the dissolved lignin and polysaccharide fragments to volatile organic compounds, including carbon dioxide, and water.

The wet oxidation of the lignin and polysaccharide fragments may be carried out simultaneously with the second step (eq. 2). However, the wet oxidation generally requires more severe conditions and longer reaction times than those required for catalyst regeneration (eq. 2) alone. It should be noted as well that significant wet oxidation would not likely occur under the conditions described in the parent applications because these applications do not describe a method for removal of solubilized lignin and polysaccharide fragments. This removal is essential for mill closure.

The present invention is a method for achieving mill closure with the reusable polyoxometalate bleaching agents. Mill closure using polyoxometalate bleaching agents could be achieved by oxidative consumption (wet oxidation) of dissolved organic materials prior to, simultaneously with, or after oxidative regeneration of the reusable polyoxometalate bleaching agent.

Oxidation State of the Polyoxometalate Anion Upon Initiation of Wet Oxidation. The criteria for polyoxometalate structures useful in anaerobic bleaching are that the complexes include vanadium ions in their highest, 5 $d^0$ electronic configurations, molybdenum ions in their, highest +6 $d^0$ electronic configurations, or d-electron-containing transition metal ions that possess sufficiently positive reduction potentials, and that may be reversibly reduced. During use in anaerobic pulping or bleaching, a significant quantity of the polyoxometalate in question is reduced. The amount of polyoxometalate reduced will vary with conditions and with the nature of the lignocellulosic substrate. If oxygen or another oxidant is present in the bleaching reactor, an additional embodiment of Ser. No. 07/937,634 now U.S. Pat. No. 5,302,248 and U.S. Ser. No. 08/219,041 filed on Mar. 28, 1994, the amount of reduced polyoxometalate emerging from the bleaching reactor might be significantly lower.

Thus, in practice, used polyoxometalate bleaching liquors are likely to contain a mixture of oxidized and reduced complexes. The percentage of reduced polyoxometalate could vary from 0 to 100%. However, because the aerobic wet oxidation stage is catalytic and the polyoxometalate operates under turnover conditions, both reduced and fully oxidized forms of the polyoxometalate will be effective. This is demonstrated in Examples 6 and 7, below.

At the elevated temperatures used during wet oxidation, fully oxidized polyoxometalate complexes may be expected to oxidize functional groups present within dissolved residual lignin and polysaccharide fragments. In the process, some percentage of the polyoxometalate present is reduced. Thus, even if the spent liquor entering the wet oxidation reactor initially contains only fully oxidized polyoxometalate complexes, some reduced polyoxometalate will be generated rapidly. The fate of these reduced species will be identical to that of the reduced species that might enter the wet oxidation reactor as a component of the spent bleaching liquor.

In the presence of oxygen gas, the reduced forms of the polyoxometalates are oxidized by oxygen generating hydrogen peroxide and other oxygen-centered radicals, and hydrogen peroxide. These might then react with the organic compounds dissolved in the bleaching liquor. In addition, dioxygen can react directly with organic radicals generated either by reaction of the organic compound with the oxidized form of a polyoxometalate, or by reaction with an oxygen-centered radical. Thus, because the reduced forms of the polyoxometalates can be oxidized with oxygen producing additional oxygen-based oxidizing species, the reduced forms of the polyoxometalates described by the general formula are also useful in the present invention. In addition, the reduced forms of the polyoxometalates can provide the added benefit of accelerating the initiation of radical-chain autoxidation of the dissolved lignin and polysaccharide fragments.

Effective removal of dissolved organic materials, the subject of the present invention, does not require polyoxometalate catalyzed wet oxidation of the organic materials completely to carbon dioxide. What is required is that the dissolved organic materials are degraded to isolable low molecular weight compounds or to volatile compounds. These compounds might be fed into the kraft liquor recovery furnace to generate heat, and there converted to carbon dioxide, or collected by separation or condensation and used as a chemical feedstock.

EXAMPLES

Polyoxometalate Bleaching: General Method. Aqueous polyoxometalate solutions, preferably 0.001 to 0.20 M, are prepared and the pH adjusted to 1.5 or higher. The polyoxometalate may be prepared as in references given in the Specification or by other standard procedures. An organic or inorganic buffer may be added to maintain the pH within a desired range during the bleaching reaction. Pulp is added to the polyoxometalate solution to a preferable consistency of approximately 1–12%, although consistencies up to 20% may be useful. The mixture is heated either in the presence or absence of oxygen or other oxidants (M or V stage, "M" refers to a d-electron-containing transition metal substituted or a molybdenum(+6) substituted polyoxometalate, while "V" refers to a vanadium(+5) substituted polyoxometalate). The temperature and duration of polyoxometalate treatment will depend upon other variables, such as the nature of the pulp, the pH of the polyoxometalate solution and the nature and concentration of the polyoxometalate.

The bleaching of chemical pulps entails two inter-related phenomena: delignification and whitening. Once a significant amount of residual kraft lignin has been removed from a kraft pulp, the pulp becomes relatively easy to whiten by a number of means, including additional polyoxometalate treatment or treatment with hydrogen peroxide or other inorganic or organic peroxides. The effectiveness of the polyoxometalates in bleaching is demonstrated by their ability to delignify unbleached kraft pulp. It is understood, however, that to meet the requirements of specific grades of market pulp, additional polyoxometalate or other oxidative treatment, such as reaction with alkaline hydrogen peroxide, might be employed to achieve final pulp whitening.

To oxidize the reduced polyoxometalate, the polyoxometalate solution may be collected after the reaction is complete, and reoxidized. The oxidant is preferably air, oxygen, a peroxide, or ozone.

The pulps are washed with water and may be extracted for 1–3 hours at 60°–85° C. in 1.0% NaOH (E stage). The cycle may be repeated in a MEME sequence, and may be followed by an alkaline hydrogen peroxide (P) stage. For the P stage, typically 30% aqueous hydrogen peroxide is added to a mixture of pulp and dilute alkali to give a final pH of approximately 9–11 and a consistency of 1–12%. The mixture is then heated for 1–2 hours at 60°–85° C. The quantity of hydrogen peroxide, defined as weight percent relative to the O.D. (oven dried) weight of the pulp may vary from 0.1–40%.

In the bleaching of chemical pulps, the polyoxometalates react with lignin to solubilize it and to render it more susceptible to extraction with hot alkali. Since many pulping processes, including the kraft process, entail delignification brought about by cooking wood chips in hot alkali, we envision that polyoxometalates will be useful in commercial pulping because of the role that polyoxometalates play in the bleaching of kraft pulp. Thus, the present invention also includes treating wood chips, wood fibers or wood meal or fibers or pulp from other lignocellulosic materials with polyoxometalates under conditions analogous to those used in the M or V stages of the bleaching process, and then pulping the chips or meal under alkaline conditions. The result is that greater reductions in lignin content are then found in polyoxometalate-treated wood or lignocellulosic material, than in wood or lignocellulosic material pulped under the same conditions, but with no polyoxometalate pre-treatment.

Wet Oxidation of Dissolved Organics. The complex evaluated was a vanadomolybdophosphate, $\alpha$-$H_5[PV_2Mo_{10}O_{40}]$ (compound 1, Formula 7, a subset of Formula 1) a representative of the $\alpha$-Keggin structural class (Kozhevnikov, I. V., et al., *Russian Chemical Reviews,* 51:1075–1088, 1982). To represent the lignin-like fragments and simple polysaccharides likely dissolved in spent bleaching liquors, two model compounds, veratryl alcohol (3,4-dimethoxybenzyl alcohol) a non-phenolic lignin model and D-glucose, a polysaccharide model, were used. In addition, a polyoxometalate bleaching liquor was prepared from compound 1, used to partially bleach a sample of kraft pulp as described in U.S. Pat. No. 5,302,248, and compared to solutions containing the lignin and polysaccharide model compounds.

Two methods were used to quantify the degradation of dissolved organic compounds during the wet oxidation reaction. The first method involved measurement of the chemical oxygen demand (COD) of the solutions (Standard Methods for the Examination of Water and Wastewater, 16th Ed., Franson, M. H, Managing Ed., American Public Health Association, Washington, D.C., 532–535, 1985). The second involved measurement of the amount of carbon dioxide evolved during wet oxidation (Mohlman, F. W., et al., *Industrial and Engineering Chemistry,* 3:119–123, 1931).

Chemical Oxygen Demand (COD). Determination of COD entails combining a measured volume of the sample to be tested with a known quantity of the oxidant potassium dichromate ($K_2Cr_2O_7$) and adding concentrated sulfuric acid (conc. $H_2SO_4$) in which has been dissolved a catalytic amount of silver sulfate ($Ag_2SO_4$). The solution is then heated to reflux (approx. 150° C.) for two hours. During this time the organic compounds in the sample are oxidized, reducing the dichromate to chromium(III) ions. Afterwards, the amount of unreacted dichromate is determined by reductive titration using ferrous ammonium sulfate ($(NH_4)_2FeSO_4$, FAS). The number of electron equivalents by which the original dichromate solution has been reduced and the organic compounds in the sample oxidized is then mathematically converted into units of milligrams of dioxygen per liter of sample (mg $O_2$/liter), each dioxygen molecule representing four electron equivalents.

In theory, the COD is the mass of dioxygen consumed if the organic compounds in the sample are completely oxidized by dioxygen to carbon dioxide and water. In practice, the COD is a measure of the degree to which dichromate is reduced under the conditions of the COD test. Thus, if the organic compounds present in the sample are not quantitatively oxidized to carbon dioxide during the COD test, the COD value determined will be less than theoretical. This means that a zero COD value does not necessarily imply the absence of dissolved organic materials.

Fortunately, the degree to which a COD value may be equated with quantitative oxidation to carbon dioxide and water (mineralization) can be ascertained by comparing measured COD values to theoretically determined ones. These comparisons are available as published data or can be readily determined experimentally for any known compound. It was found experimentally that D-glucose and 1,3-dimethoxybenzyl alcohol (veratryl alcohol) are quantitatively oxidized to carbon dioxide and water during the COD test. It is reasonable to expect that the products of partial oxidation of these compounds will also be quantitatively mineralized during the COD test. Thus, in the Examples, where the model compounds D-glucose or 1,3-dimethoxybenzyl alcohol are used, COD values may reasonably be taken to represent the total concentration of reducing equivalents of organic carbon present. It follows that reductions in COD values, brought about by polyoxometalate catalyzed wet oxidation of these model compounds, are a valid measure of the extent to which the model compounds have been oxidized.

For actual bleaching liquors containing uncharacterized mixtures of lignin and polysaccharide fragments, the conditions of the COD test are expected to convert most of the dissolved organic compounds to carbon dioxide and water. This expectation is supported as follows. First, the COD test is performed in hot concentrated acid, where cellulose and other polysaccharides are rapidly hydrolyzed to glucose and other simple sugars, all of which may be expected, like D-glucose, to be completely oxidized by acidic dichromate to carbon dioxide and water (mineralized). This assumption is supported by published data demonstrating that D-glucose and cellulose are completely mineralized, and lactose, the β-D-galactoside of D-glucose, is mineralized to 97.4% of theoretical (Moore, A. W., et al., *Analytical Chemistry,* 21:953–957, 1949). Secondly, based upon the structure of lignin, and proposed structures of residual kraft lignin, dissolved lignin fragments are expected to contain oxygenated, substituted aromatic compounds, e.g., possessing substituents such as hydroxyl and methoxyl groups, α-alcohols, α-ketones and s-acids. Furthermore, by virtue of their water solubility, the lignin fragments dissolved in spent bleaching liquors undoubtedly possess these polar functional groups. Based upon published data (Moore, A. W., et al., *Analytical Chemistry,* 23:1297–1300, 1951 and ibid., 35:1064–1067, 1963) these substituted lignin fragments, along with simpler aliphatic alcohols and organic acids that might be present, should be quantitatively, or nearly quantitatively, oxidized to carbon dioxide and water during the COD determination.

One possible complication, however, is that the degree of acid dichromate mineralization of condensed aromatic structures, i.e., those containing carbon-carbon bonds between the carbon atoms that make up the $C_6$ units of aromatic rings, have not, to our knowledge, been reported. Because of this, and given uncertainty as to the precise composition of the various organic compounds present in spent bleaching liquors, care must be taken in equating COD values with the concentration of reducing equivalents of organic carbon present in spent bleaching liquor samples.

Quantification of Evolved Gases. After completion of the wet oxidation reaction, gases evolved during the reaction were analyzed for carbon dioxide by adaptation of a published method (Mohlman, F. W., et al., *Industrial and Engineering Chemistry,* 3:119–123, 1931). This test involved passing the gas contained in the head space of the high pressure wet oxidation reactor through a standard barium hydroxide solution. As each equivalent of carbon dioxide consumes two equivalents of hydroxide, the amount of carbon dioxide was then determined by acid-base titration of the barium hydroxide solution. The mass of $CO_2$ detected was then divided by the volume of the solution subjected to wet oxidation and reported as mg $CO_2$/L.

Other volatile materials generated during wet oxidation might include low molecular weight alcohols, aldehydes, ketones and acids. To determine the amount of these organic compounds present in the head space after wet oxidation, the head-space gas was evacuated from the Parr bomb via a liquid nitrogen cold trap and the COD of the condensate was determined.

Phosphorus-31 Nuclear Magnetic Resonance ($^{31}$p NMR). Spectroscopy. $^{31}$p NMR spectroscopy was used to confirm that degradation of α-$H_5[PV_2Mo_{10}O_{40}]$ (compound 1) did not occur during wet oxidation.

Kappa numbers. Kappa numbers, obtained by permanganate oxidation of residual lignin, are an index of how much lignin is present within a wood or pulp sample. Although difficult to measure accurately or to interpret when only small amounts of lignin are present, kappa numbers are a widely used and easily recognized index of lignin content. For relatively small pulp samples, microkappa numbers are determined. Microkappa numbers were obtained using TAPPI methods T236 om-85 and um-246. In two of the Examples, microkappa numbers were determined for polyoxometalate treated pulp samples. The microkappa number determined for the unbleached kraft pulp used in these Examples was 33.6. Microkappa number determinations are used in Examples 1, 6 and 7 below as a rough indication of how much lignin is removed from the pulp, and presumably solubilized in the bleaching liquor, during polyoxometalate bleaching.

Wet Oxidation; General method. Aerobic, polyoxometalate-catalyzed wet oxidation of lignin and polysaccharide fragments dissolved in spent polyoxometalate bleaching liquors requires heating the spent liquor in the presence of an oxidant, such as oxygen. Key variables in the wet oxidation reaction are: concentration of dissolved oxygen, reaction temperature, reaction time, polyoxometalate concentration and pH.

The concentration of dissolved oxygen is a function of its absolute pressure, temperature, the nature of the soluble ions present, ionic strength of the spent liquor and reaction rate. However, the rate and extent of the wet oxidation reaction will likely depend most heavily on three variables: oxygen pressure, temperature and time. As a result, only general limits may be assigned to any one of these parameters. Nonetheless, it is expected that absolute oxygen pressures of from 15 to 1000 pounds per square inch (psia), reaction temperatures of from 100° to 400° C. and reaction times of from 0.5 to 10 hours will encompass the most likely configurations of these variables.

A preferable range of oxidation time is 1.0 to 5.0 hrs. Most preferably, the reaction time is 3.0 to 4.0 hrs.

A preferable range of reaction temperature is between 125° C. and 225° C. Most preferably, the reaction temperature is 150° C.

A preferable oxygen pressure during the heating step is 15 to 1000 psia. Most preferably, a pressure of approximately 100 psia is maintained.

Polyoxometalate concentrations and pH values will likely be influenced by the requirements of the delignification and bleaching reactions. Nonetheless, dilution or concentration of spent bleaching liquors may be advantageous prior to the wet oxidation stage. However, because a buffer will probably be necessary for the bleaching reaction, the pH values encountered in the wet oxidation reactor are likely to be similar to those used in bleaching. Thus, for bleaching and wet oxidation in the continuous process, useful pH values are likely to range from one to 10.

Preferably, pH values of between 1.5 and 3.5 will be obtained. Most preferably, pH values between 2.0 and 3.0 will be obtained.

Polyoxometalate concentrations are likely to lie within an order of magnitude above or below those suggested above for use in bleaching. Thus, polyoxometalate concentrations of from 0.1 mM to 2.0 M are anticipated.

The wet oxidation experiments described in the Examples below involved heating either polyoxometalate solutions containing model compounds, or spent polyoxometalate bleaching liquors, to a temperature of 150°–200° C. under 100 psia (pounds per square inch absolute pressure) of dioxygen gas for three to four hours in a glass lined, one liter, high pressure Parr reactor, which was fitted with a propeller for stirring. Total pressures, including those exerted by steam, were approximately 205–400 psia. COD values along with quantities of carbon dioxide generated as a result of wet oxidation, were then determined.

Stock solutions of model compounds were prepared by dissolving veratryl alcohol (200.3 mg/L) and D-glucose (375.1 mg/L) in purified water. Each stock solution had a theoretical COD value of 400 mg $O_2$/L. Measured COD values for these compounds were, for veratryl alcohol 405.4± 9.8 mg $O_2$/L and 416.1±10.1 mg $O_2$/L (two different stock solutions) and 413.3± 10.1 mg $O_2$/L for D-glucose. Control experiments, without catalyst added, were performed on the undiluted stock solutions, adjusted to pH 3 by addition of conc. sulfuric acid.

For experiments using $\alpha$-$H_5[PV_2Mo_{10}O_{40}]$ (compound 1) to catalyze the oxidation of model compounds, 0.048 M solutions of compound 1 were prepared by dissolving $\alpha$-$H_5[PV_2Mo_{10}O_{40}].30H_2O$, 113.8 g/L, in the stock model compound solutions. The pH of each solution was adjusted to 3 using sodium bicarbonate. Final COD and $CO_2$ values were adjusted to account for the 5.0% increases in volumes that resulted from addition of compound 1 and sodium bicarbonate to the stock model compound solutions. At the end of each wet oxidation reaction, compound 1 was in its fully oxidized form and did not interfere with the COD determination.

For experiments in which spent polyoxometalate bleaching liquors were subjected to wet oxidation conditions, a spent bleaching liquor was prepared by heating a sample of kraft pulp (microkappa number of 33.6) under nitrogen and with stirring, in a solution of $\alpha$-$H_5[PV_2Mo_{10}O_{40}]$ (compound 1). At the end of the bleaching reaction, a significant portion of the vanadium(+5) in the solution had been reduced to vanadium(+4). The concentration of reduced vanadium was determined titrametrically and subtracted from the COD values determined for an aliquot of the partially reduced, spent liquor. The spent liquor was then heated to 150° C. for four hours under 100 psia oxygen. At the end of this time, a second COD measurement was made to determine the extent of oxidation of the organic compounds present in the bleaching liquor. In one case, three bleaching-wet oxidation cycles were performed in succession to demonstrate how polyoxometalates might be employed as reusable agents in an effluent-free (closed) mill. At the end of the multi-cycle experiment, $^{31}$p NMR was used to confirm that no degradation of the polyoxometalate bleaching agent/wet oxidation catalyst had occurred.

After completion of each wet oxidation reaction, the Parr reactor was cooled to near room temperature and the headspace gases passed through a standard solution of barium hydroxide. The barium hydroxide solutions were located in a vertical glass chromatography column filled with glass beads. The headspace gases were introduced at the bottom of the column. During the course of the work, this method was altered to increase the efficiency of the reaction of $CO_2$ with barium hydroxide and to decrease the uncertainty present in calculated values (see the last two entries in Table 3, below). Instead of glass beads, a foaming agent (isopropanol, 2% by volume) was added and the volume of the barium hydroxide solution reduced by approximately 85%. After initial release of headspace gases into the barium hydroxide column, the reactor was purged with purified nitrogen and the nitrogen stream routed through the barium hydroxide solution.

COD measurements were performed using 50 mL aliquots of model compound solutions or bleaching liquors, both before and after wet oxidation. Necessary titrametric standards and blanks were obtained and updated as necessary to minimize error in the COD and $CO_2$ measurements.

Example 1

$\alpha$-$H_5[PV_2Mo_{10}O_{40}]$(compound 1); VEP Sequence.

2.0 g oven-dried (O.D.) weight of mixed pine kraft pulp was added to a 0.100 M solution of compound 1, adjusted to a pH of 1.45 by addition of 1N NaOH, to a final consistency of 3.0% in a 100 mL round-bottomed flask. The pH of the mixture was 1.54. The flask was sealed in air and heated in a 100° C. bath for four hours. During heating, the solution changed from orange to dark green-brown.

The pulp, now somewhat darker and slightly reddish-brown in color, was collected on a Buchner funnel and the partially reduced polyoxometalate solution (pH=1.98) was saved.

The partially reduced polyoxometalate solution was titrated to an orange endpoint with ceric ammonium sulfate. 3.2% of the vanadium(V) present, or $2.07\times10^{-4}$ mol of V(V) per 1.0 g O.D. pulp, had been reduced to vanadium(IV). (The oxidation states of metal ions may be designated by Roman as well as by Aramaic numerals. Thus, vanadium(V) is equivalent to vanadium(+5)).

The pulp was washed three times with water and heated for three hours at 85° C. in 1.0% aqueous NaOH at a consistency of 3.2% in an open round-bottomed flask. At the end of this time the alkali solution was brown, and the pulp had lost some of its dark reddish color. After collecting and washing the pulp with water, a portion was treated with 40% $H_2O_2$, relative to the O.D. weight of the pulp, at a consistency of 2.0% for 1.5 hours at 85° C. and an initial pH of 10.42.

A control experiment was performed in parallel under identical conditions, but without added polyoxometalates. In the control, no darkening of the pulp occurred in the first stage ($\Delta$) and little color was observed in the aqueous NaOH solution after the E stage.

Prior to reuse of the polyoxometalate solution, air was bubbled gently through the polyoxometalate solution for 1.5 hours at 60° C., and the pH of the solution was then adjusted to 1.5 with concentrated $H_2SO_4$. The reoxidation was monitored spectrophotometrically. After reoxidation, the $^{13}$P NMR spectrum of the reoxidized polyoxometalate solution was obtained. No phosphorus-containing decomposition products were observed.

Table 1 describes kappa number and brightness measurements for the V, E and P stages of Example 1. The kappa number, indicating the amount of lignin present, is lower in the VE measurements as opposed to the Δ and ΔE measurements. Significant delignification is evident after the E stage in the polyoxometalate treated pulp, while brightening does not occur until the P stage.

The asterisk in Table 1 indicates a value too low to be determined accurately.

TABLE 1

| | Kappa No. | Brightness | | Kappa No. | Brightness |
|---|---|---|---|---|---|
| V | 19.2 | 19.1 | Δ | 24.7 | 31.7 |
| E | 10.7 | 26.7 | E | 18.9 | 33.5 |
| P | (1.7)* | 71.2 | P | 7.2 | 55.9 |

To determine the viscosity of the pulp after the V and Δ stages, compound 1 was used as described above, but with careful exclusion of dioxygen during the V stage. Pulp viscosities, measured after V and Δ, and after VE and ΔE are tabulated below in Table 2.

In the present invention, the efficacy of the polyoxometalate compounds 1–4, was demonstrated at low pH values of 1.5 to 2.5. After heating at these pH values for four hours at 100° C., substantial acid-catalyzed degradation of the cellulose fibers occurs. As a result of the low pH values used in the examples, pulp viscosities are all lower than they would have been if the reactions were done at higher pH values. Many polyoxometalates included in the general formula are stable at higher pH values. However, the stability of compound 1 at higher pH values has not been firmly established. In order to demonstrate the efficacy of compound 1 as a bleaching agent as quickly as possible, we chose a low pH at which this material is known to be stable at elevated temperatures.

Therefore, although the viscosities reported here are low, the relatively small differences between the polyoxometalate-treated pulps and the control pulps heated at the same pH, but with no added polyoxometalates suggest that when run at higher pH values, the polyoxometalate-treated pulps should meet industry standards. This has since been demonstrated at pH 7 using a vanadium-substituted polyoxometalate of Formula 1 ($\alpha$-$K_5[SiVW_{11}O_{40}]$, Weinstock, et al., Proceedings of the 1993 TAPPI Pulping Conference; 1993 November 1–3; Atlanta, Ga., 519–532) and a d-electron-containing transition metal-substituted polyoxometalate of Formula 1 ($\alpha$-$K_5[SiMn(III)(H_2O)W_{11}O_{39}]$). Both of these compounds proved to be more selective in terms of pulp viscosity than traditional elemental chlorine and alkali treatments. In addition, both compounds are closely structurally related to those defined by Formulas 3, 5, 7 and 8, subsets of the General Formula.

TABLE 2

| | η | | η | |
|---|---|---|---|---|
| V | 6.52 | Δ | 11.04 | $\eta_{(\Delta-V)} = 4.52$ |
| E | 6.58 | E | 12.03 | $\eta_{(\Delta-V)} = 5.45$ |

Example 2

Catalytic Wet Oxidation of Veratryl Alcohol (1,3-dimethoxybenzyl alcohol) by $\alpha$-$H_5[PV_2Mo_{10}O_{40}]$ (compound 1) and Oxygen; Temperature Profile A.

A solution of compound 1 and veratryl alcohol was prepared as described above in the General Method. 150 mL of this solution were transferred to the Parr reactor, which was purged and pressurized to 100 psia with purified oxygen gas, heated to 150° C., and stirred at this temperature for four hours. The final pH was 2.6, and all of the compound 1 present was fully oxidized. After cooling the reactor to room temperature, the amount of $CO_2$ in the headspace and the COD of the solution were determined as described above. The COD of the solution had dropped from 396± 17 to 114± 20 mg $O_2$/L and 63± 72 mg/L of $CO_2$ (13± 15 percent of theoretical, the large uncertainty is due to the use of excess barium hydroxide solution) were found in the headspace gas.

The wet oxidation reaction was repeated using 100 mL of solution and the headspace gas was passed through a liquid nitrogen trap to condense volatile organic compounds. The COD values of both the reaction solution and of the headspace gas condensate were then determined. Of the original COD of the solution (396±17 mg $O_2$/L), 95±21 mg $O_2$/L were found in the reaction solution and 15±4 mg $O_2$/L in the condensate of the headspace gas. The temperature of the reactor during release of the headspace gases was 50° C. At this temperature, the partial pressures of water-soluble volatile organic compounds are likely to be small.

A control experiment was performed using 100 mL of a stock veratryl alcohol solution and no added catalyst. The final pH, after wet oxidation, was 3.0. During the reaction, the COD dropped from 416± 10 to 384± 10 mg $O_2$/L, and 30± 12 mg/L of $CO_2$ (6± 3 percent of theoretical, foaming agent method) were found in the headspace gas.

Example 3

Catalytic Wet Oxidation of Veratryl Alcohol (1,3-dimethoxybenzyl alcohol) by $\alpha$-$H_5[PV_2Mo_{10}O_{40}]$ (compound 1) and Oxygen; Temperature Profile B.

A solution of compound 1 and veratryl alcohol was prepared as described above in the General Methods. 102 mL of this solution was transferred to the Parr reactor, which was purged and pressurized to 100 psia with purified oxygen gas, heated to 150° C. for two hours followed by one hour at 200° C. The final pH was 2.2, and all of the compound 1 present was fully oxidized. After cooling the reactor to room temperature, the amount of $CO_2$ in the headspace and the COD of the solution were determined as described above. The COD of the solution had dropped from 396± 17 to 89±21 mg $O_2$/L and 199±83 mg/L of $CO_2$ (42± 18 percent of theoretical, glass bead method) were found in the headspace gas.

A control experiment was performed using 100 mL of a stock veratryl alcohol solution and no added catalyst. The final pH, after wet oxidation, was 3.2. During the reaction, the COD dropped from 416± 10 to 375± 10 mg $O_2$/L and −8±103 mg/L of $CO_2$ (−2±22 percent of theoretical, glass bead method) were found in the headspace gas. A variant of this control, in which the final temperature (200 ° C.) was maintained for one-half rather than one hour, gave a similar result: the final pH was 3.0 and the COD dropped from 416± 10 to 356± 10 mg $O_2$/L and 14± 11 mg/L of $CO_2$ (3± 2 percent of theoretical, foaming agent method) were found in the headspace gas.

Example 4

Catalytic Wet Oxidation of D-glucose by α-$H_5[PV_2Mo_{10}O_{40}]$ (compound 1) and Oxygen; Temperature Profile A.

A solution of compound 1 and D-glucose was prepared as described above in the General Methods. 150 mL of the solution was transferred to the Parr reactor, which was purged and pressurized to 100 psia with purified oxygen gas, heated to 150° C., and stirred at this temperature for four hours. The final pH was 2.3, and all of the compound 1 present was fully oxidized. After cooling the reactor to room temperature, the amount of $CO_2$ in the headspace and the COD of the solution were determined as described above. The COD of the solution had dropped from 396± 17 to 75± 20 mg $O_2$/L and 194±60 mg/L of $CO_2$ (35±11 percent of theoretical, glass bead method) were found in the headspace gas.

A control experiment was performed using 100 mL of the stock D-glucose solution and no added catalyst. The final pH, after wet oxidation, was 2.9. During the reaction, the COD dropped from 413± 10 to 309±10 mg $O_2$/L and 67±54 mg/L of $CO_2$ (12± 10 percent of theoretical, glass bead method) were found in the headspace gas.

Example 5

Catalytic Wet Oxidation of D-glucose by α-$H_5[PV_2Mo_{10}O_{40}]$ (compound 1) and Oxygen; Temperature Profile B.

A solution of compound 1 and D-glucose was prepared as described above in the General Method. 100 mL of the solution were transferred to the Parr reactor, which was purged and pressurized to 100 psia with purified oxygen gas, heated to 150° C. for two hours and to 200° C. for one hour. The final pH was 2.1, and all of the compound 1 present was fully oxidized. After cooling the reactor to room temperature, the amount of $CO_2$ in the headspace and the COD of the solution were determined as described above. The COD of the solution had dropped from 396± 17 to 46± 22 mg $O_2$/L and 233±110 mg/L of $CO_2$ (42± 20 percent of theoretical, glass bead method) were found in the headspace gas.

A control experiment was performed using 100 mL of the stock D-glucose solution and no added catalyst. The final pH, after wet oxidation, was 2.9. During the reaction, the COD dropped from 413± 10 to 137± 10 mg $O_2$/L and 328± 12 mg/L of $CO_2$ (60± 4 percent of theoretical, foaming agent method) were found in the headspace gas.

Results of the model compound studies are presented below in Table 3.

TABLE 3

COD and $CO_2$ values of model compound solutions after wet oxidation by oxygen in the presence and absence of α-$H_5[PV_2Mo_{10}O_{40}]$ (compound 1).

| model compound | [cpd 1] (mol/L) | Temp. profile | Initial COD (mg $O_2$/L) | Final COD (mg $O_2$/L) | $CO_2$ evolved (mg/L) | $CO_2$ evolved (% theor.) |
|---|---|---|---|---|---|---|
| V. Alcohol | 0.048 | A | 396 ± 17 | 114 ± 20 | 63 ± 72* | 13 ± 15 |
| V. Alcohol | 0.0 | A | 416 ± 10 | 384 ± 10 | 30 ± 12‡ | 6 ± 3 |
| V. Alcohol | 0.048 | B | 396 ± 17 | 89 ± 21 | 199 ± 83† | 42 ± 18 |
| V. Alcohol | 0.0 | B | 416 ± 10 | 375 ± 17 | −8 ± 103† | −2 ± 22 |
| D-glucose | 0.048 | A | 396 ± 17 | 75 ± 20 | 194 ± 60† | 35 ± 11 |
| D-glucose | 0.0 | A | 413 ± 10 | 309 ± 10 | 67 ± 54† | 12 ± 10 |
| D-glucose | 0.048 | B | 396 ± 17 | 46 ± 22 | 233 ± 110† | 42 ± 20 |
| D-glucose | 0.0 | B | 413 ± 10 | 137 ± 10 | 328 ± 12‡ | 60 ± 4 |

*see text, Example 1
† glass bead method
‡ foaming agent added to barium hydroxide solution
A four hours @ 150° C. under 100 psia $O_2$
B two hours @ 150° C. and one hour @ 200° C., all under 100 psia $O_2$
[cpd 1] = molar concentration of (α-$H_5[PV_2Mo_{10}O_{40}]$
V. Alcohol = veratryl alcohol (1,3-dimethoxybenzyl alcohol)

Example 6

Catalytic Wet Oxidation of a Partially Spent α-$H_5[PV_2MO_{10}O_{40}]$ (compound 1) Bleaching Liquor by Oxygen.

To prepare a partially spent bleaching liquor, 6.2 g oven-dried (O.D.) weight of mixed-pine kraft pulp were added to a 0.05 M solution of compound 1, to a final consistency of 3.0% in a glass-lined one liter Parr high pressure reactor. The pH of the mixture was adjusted to 3.0. The reactor was purged with purified nitrogen and heated to 100° C. for four hours. During heating, the solution changed from orange to dark green-brown.

The pulp was then collected on a Büchner funnel and the partially reduced polyoxometalate solution (pH=2.9) was saved. The microkappa number of the partially bleached pulp was 29.5. A small aliquot of the partially reduced polyoxometalate solution was titrated to an orange endpoint with ceric ammonium sulfate. 29% of the vanadium(+5) present had been reduced to vanadium(+4). The COD of the spent liquor, determined using a portion of the partially reduced liquor and subtracting the concentration of reduced vanadium, was 644± 17 mg $O_2$/L.

75 mL of the partially reduced spent liquor was than purged and heated under 100 psia oxygen gas for four hours at 150° C. The final pH was 3.0, and all of the compound 1 present was fully oxidized. After the reaction, 383± 84 mg/L $CO_2$ (glass bead method) were found in the headspace gas and the COD of the solution had dropped to 232± 19 mg $O_2$/L.

Example 7

Repeated Cycles of Bleaching and Catalytic Wet Oxidation of Dissolved Organics Using α-$H_5[PV_2Mo_{10}O_{40}]$ (compound 1) and Oxygen.

A partially spent $\alpha$-$H_5[PV_2Mo_{10}O_{40}]$ bleaching liquor was prepared as described in Example 5 using 10.1 g O.D. weight of mixed-pine kraft pulp. During polyoxometalate treatment the microkappa number of the pulp dropped to 27.2. The final pH was 2.9 and 14% of the vanadium(+5) present was reduced. After bleaching, the COD of the partially reduced bleaching liquor was 793± 26 mg $O_2$/L. The pH of the solution was adjusted to 3.0 and 243 mL were heated under 100 psia oxygen for four hours at 150° C. The final pH was 2.9. 419± 4 mg/L $CO_2$ (foaming agent method) were found in the headspace gas and the COD of the solution had dropped to 317± 30 mg $O_2$/L. The cycle was repeated two more times. Data pertaining to the conditions used in the bleaching and wet oxidation stages are summarized in Table 4a. Results of the bleaching and wet oxidation stages are presented in Table 4b. All $CO_2$ measurements were made using isopropanol as a foaming agent.

TABLE 4a

Conditions used for each process step, bleaching and wet oxidation, where $\alpha$-$H_5[PV_2Mo_{10}O_{40}]$ was used for three successive cycles of anaerobic bleaching and aerobic wet oxidation.

| | [cpd 1] (mol/L) | mass pulp (grams) | csc (%) | Vol (mL) | pH (initial) |
|---|---|---|---|---|---|
| Bleach 1 | 0.050 | 10.1 | 3.0 | 327 | 3.0 |
| Ox 1 | 0.050 | n.a. | n.a. | 243 | 3.0 |
| Bleach 2 | 0.047 | 6.0 | 2.8 | 206 | 3.0 |
| Ox 2 | 0.044 | n.a. | n.a. | 150 | 3.0 |
| Bleach 3 | 0.042 | 3.6 | 2.8 | 123 | 3.0 |
| Ox 3 | 0.049 | n.a. | n.a. | 69 | 3.0 |

[cpd 1] = molar concentration of $\alpha$-$H_5[PV_2Mo_{10}O_{40}]$
csc = consistency
n.a. = not applicable
Bleach 1 = first bleaching stage
Ox 1 = first catalytic wet oxidation stage TABLE 4b Results obtained after each process step, bleaching and wet oxidation, where $\alpha$-$H_5[PV_2Mo_{10}O_{40}]$ was used for three successive cycles of anaerobic bleaching and aerobic wet oxidation.

| | pH (final) | Reduction (%)* | micro-kappa no. | Final COD (mg $O_2$/L) | $CO_2$ (mg/L)‡ |
|---|---|---|---|---|---|
| Bleach 1 | 2.9 | 14 | 27.2 | 793 ± 26 | — |
| Ox 1 | 2.9 | n.a. | n.a. | 317 ± 30 | 419 ± 4 |
| Bleach 2 | 3.2 | 17 | 26.1 | 879 ± 54 | 114 ± 5 |
| Ox 2 | 3.0 | n.a. | n.a. | 524 ± 45 | 400 ± 11 |
| Bleach 3 | 3.2 | 17 | 26.7 | 1015 ± 113 | 118 ± 9 |
| Ox 3 | 2.9 | n.a. | n.a. | 654 ± 83 | 517 ± 26 |

Figure 3:
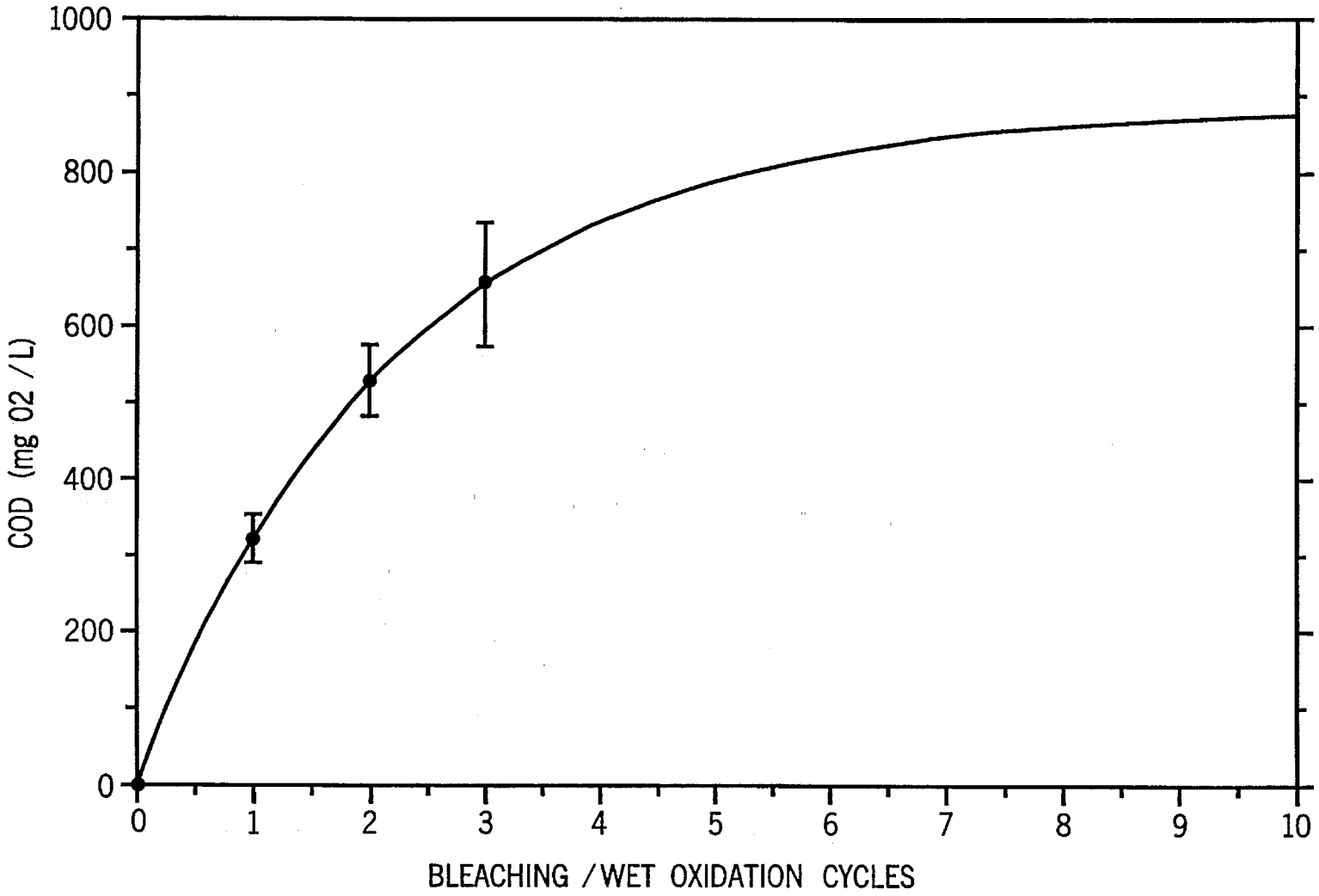
FIG. 3 is a plot of COD values measured after successive cycles of polyoxometalate bleaching and wet oxidation. A least squares fit of the wet oxidation (COD) data was calculated using a mathematical model that assumes exponential decay to an asymptotic value.

— = no data available
*amount of vanadium reduced as a percent of the total vanadium present
‡foaming agent added to barium hydroxide solution
n.a. = not applicable
Bleach 1 = first bleaching stage
Ox 1 = first catalytic wet oxidation stage The purpose of Example 7 was two-fold: to demonstrate the use of compound 1 in repeated cycles of bleaching and wet oxidation, and to determine whether additional more easily oxidized organic compounds introduced during bleaching might act as "sacrificial reductants" to bring about an eventual steady state COD value for the subsequently oxidized liquors. A least squares fit of the wet oxidation (COD) data, based on a mathematical model that assumes exponential decay to an asymptotic value, is presented in FIG. 3. The equation used was $COD=COD_s\exp\{-aT(i)\}$ where $COD_s$= the final steady state COD value, 1/a represents the number of cycles for the COD to reach 63% of its steady-state value, and T(i)= number of bleaching/wet oxidation cycles. The initial COD value of zero (cycle 0) was included in the least squares fit. Although the available data are consistent with this model, more work is needed to verify its applicability.

Example 8

Use of Ozone to Augment Catalytic Wet Oxidation by $\alpha$-$H_5[PV_2Mo_{10}O_{40}]$ (Compound 1) and Oxygen.

50 mL of a solution having a COD after catalytic wet oxidation of 122 mg $O_2$/L and a pH of 2.4 was prepared using $\alpha$-$H_5[PV_2Mo_{10}O_{40}]$ (compound 1) as described in Example 1. It was then sparged with a hydrated mixture of ozone and oxygen gases (3.0% $O_3$ in $O_2$) at a rate of 1 L/min at room temperature for one hour. After exposure to ozone, the pH of the solution was 2.4 and its COD was 8± 22 mg $O_2$/L. The minimum quantity of ozone gas required to reduce the COD to this extent was not determined, but is probably much less than the amount applied here.

Example 9

Phosphorus-31 Nuclear Magnetic Resonance Spectra of Polyoxometalate Solutions.

The integrity of $\alpha$-$[PV_2Mo_{10}O_{40}]^{5-}$ (compound 1) after wet oxidation of model compounds, and after use in repeated cycles of bleaching and wet oxidation, was confirmed by $^{31}P$ NMR spectroscopy. The $^{31}P$ NMR spectra were acquired using solutions of $\alpha$-$H_5[PV_2Mo_{10}O_{40}]$ diluted by addition of $D_2O$, and were externally referenced to 85% phosphoric acid. Samples were placed in 5 nun NMR tubes and spectra acquired on a 250 MHz instrument.

Spectra of solutions of $\alpha$-$[PV_2Mo_{10}O_{40}]^{5-}$ were recorded after each wet oxidation reaction described in Examples 2–5. In solutions obtained from Examples 2–4, no decomposition products were observed. In the solution obtained from Example 5, Catalytic Wet Oxidation of D-glucose-Temperature Profile B, a small signal (< 5% of the total integrated area of the spectrum) was observed at −0.3 ppm.

Significantly, no decomposition was observed in the polyoxometalate solution that had been used for three successive cycles of bleaching and catalytic wet oxidation (Example 7).

In prior work (Ser. No. 07/937,634now U.S. Pat. No. 5,302,248), no polyoxometalate degradation was expected or observed when a partially reduced bleaching solution containing $\alpha$-$H_5[PV_2Mo_{10}O_{40}]$ (compound 1) was heated,to 100° C. and reoxidized by exposure to ozone (3.0% $O_3$ in $O_2$) at a rate of 0.1 L/min for one minute (initial pH=2.18, final pH=1.46).

In the General Description of the present invention, polyoxometalate structures useful in anaerobic bleaching were defined as those containing vanadium ions in their highest, +5 $d^0$ electronic configurations, molybdenum ions in their highest +6 $d^0$ electronic configurations, or d-electron-containing transition metal ions possessing sufficiently positive reduction potentials. Effective in anaerobic bleaching, these polyoxometalates must directly oxidize a range of organic functional groups. In addition, reduction of these polyoxometalates, all subsets of the general formula, is known to occur reversibly. Thus, at the elevated temperatures suggested for use in catalytic wet oxidation, these polyoxometalates probably oxidize functional groups present in dissolved lignin and polysaccharide fragments. In the presence of oxygen (aerobic wet oxidation), they undoubtedly initiate a variety of radical-chain autoxidation reactions.

Both processes, direct oxidation of organic functional groups and reversible reduction/reoxidation, likely occur during the reactions described in Examples 2–7 above. First, because compound 1 is capable of the anaerobic oxidation of organic functional groups under moderate conditions (see Examples 1, 6 and 7) it is likely that the direct oxidation of a wider range of functional groups will occur more rapidly under the higher temperatures suggested for wet oxidation. A likely mechanism by which the wet oxidation reaction(s) can occur catalytically, as the data presented in Examples 2–7 suggest, requires that compound 1, at least initially, directly oxidize some organic functional groups. Secondly, because the wet oxidation reaction is catalytic in polyoxometalate, the vanadium ions in compound 1 probably cycle between more than one oxidation state the most likely being oxidation states +5 ($d^0$ fully oxidized) and +4 ($d^1$, one electron reduced). The reversibility of the vanadium(+5)/vanadium(+4) couple likely plays an important role in the course of the radical-chain autoxidation reactions.

Like compound 1, molybdenum(+6) ($d^0$ electronic configuration) and d-electron-containing transition metal ion substituted polyoxometalates of the general formula and useful in anaerobic oxidative delignification are reversible oxidants. Capable of direct oxidation of organic substrates and of reversible reduction, these materials are expected to be useful in the present invention because they meet the criteria most reasonably responsible for the demonstrated effectiveness of compound 1.

We claim:

1. A method for oxidative degradation of lignin and polysaccharide fragments dissolved during polyoxometalate treatment of wood pulp, comprising the steps of:

obtaining a wood pulp;

mixing the wood pulp with a solution of a polyoxometalate of the formula $[V_lMo_mW_nNb_QTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where l+ m+ n+o+p≧4, 1+ m+ q>0 and s is sufficiently large that x>0, wherein the pulp is of a consistency of 1–20%, wherein the pulp is delignified, the polyoxometalate is reduced, and the lignin and polysaccharide fragments within the pulp are dissolved, and wherein a liquor is obtained that contains the polyoxometalate and dissolved lignin and polysaccharide fragments, and heating the liquor in the presence of a gaseous oxidant, wherein oxidation takes place, under conditions wherein the polyoxometalate is oxidized and the dissolved lignin and polysaccharide fragments are catalytically and oxidatively degraded by the oxidant and the polyoxometalate to volatile organic compounds and water, wherein the pressure of the oxidant in the heating step is 15 to 1000 psia, wherein the temperature of the heating step is between 100° C. and 400° C., wherein the heating step is performed at final pH of between 1.0 And 10.0, wherein the time of oxidation is between 0.5 hr and 10.0 hrs, and wherein the heating step takes place in a vessel capable of withstanding said pressure.

2. The method of claim 1 wherein the polyoxometalate is of the formula $[V_lMo_mW_n(TM)_oX_pO_q]^{x-}$, where TM is any d-electron-containing transition metal ion, X is a heteroatom, which is a p or d block element, l+ m+ n+ o=12, p=1, o≦4 and l+ m+ o> 0 and wherein q is sufficiently large that x> 0.

3. The method of claim 1 wherein the polyoxometalate is of the formula $[V_lMo_mW_n(TM)_oX_pO_q]^{x-}$, where TM is any d-electron-containing transition metal ion, X is a heteroatom, which is a p or d block element, l+m+ n+ o=22, l+ o is 1–4 and p=2 and wherein g is sufficiently large that x>0.

4. The method of claim 1 wherein the polyoxometalate is of the formula $[V_lMo_mW_n(TM)_oX_pO_q]^{x-}$, where TM is any d-electron-containing transition metal ion, X is either $P^{5+}$, $As^{5+}$, $S^{6+}$, l+ m+ n+ o= 18, o≦6, p=2 and l+ m+ o>0 and wherein g is sufficiently large that x>0.

5. The method of claim 1 wherein the polyoxometalate is of the formula $[MO_mW_n(TM)_4X_pO_q]^{x-}$, where TM is any d-electron-containing transition metal ion, X is either $P^{5+}$, $As^{5+}$ or $S^{6+}$, m+ n=30 and p= 4 and wherein q is sufficiently large that x> 0.

6. The method of claim 1 wherein the oxidant is air.

7. The method of claim 1 wherein the oxidant is oxygen.

8. The method of claim 1 wherein the oxidant is ozone.

9. The method of claim 1 wherein the heating step is between 125° C. and 225° C.

10. The method of claim 1 wherein the heating step takes place at 150° C.

11. The method of claim 1 wherein the heating step is performed at a final pH of between 1.5 and 3.5.

12. The method of claim 1 wherein the heating step is performed at a final pH of between 2.0 and 3.0.

13. The method of claim 1 wherein the time of oxidation is between 1.0 hr and 5.0 hrs.

14. The method of claim 1 wherein the time of oxidation is between 3.0 hrs and 4.0 hrs.

15. The method of claim 1 wherein the oxidant is oxygen and the pressure of oxygen in the heating step is 100 psia.

16. The method of claim 1 wherein at least 14% of the polyoxometalate has been reduced.

17. The method of claim 1 additionally comprising the step of returning the oxidized polyoxometalate liquor to a reactor for reuse in bleaching.

18. A method for oxidative degradation of lignin and polysaccharide fragments dissolved during polyoxometalate treatment of wood fiber, comprising the steps of:

obtaining wood fiber;

mixing the wood fiber with a solution of a polyoxometalate of the formula $[V_lMo_mW_nNb_oTa_p(TM)_q\ X_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where l+m+n+o+ p≧4, l+ m+ q> 0 and s is sufficiently large that x> 0, wherein the fiber is of a consistency of 1–20%, wherein the fiber is delignified, the polyoxometalate is reduced, and the lignin and polysaccharide fragments within the pulp are dissolved, and wherein a liquor is obtained that contains the polyoxometalate and dissolved lignin and polysaccharide fragments, and heating the liquor in the presence of a gaseous oxidant, wherein oxidation takes place, under conditions wherein the polyoxometalate is oxidized and the dissolved lignin and polysaccharide fragments are catalytically and oxidatively degraded by the oxidant and the polyoxometalate to volatile organic compounds and water, wherein the pressure of the oxidant in the heating step is 15 to 1000 psia, wherein the temperature of the heating step is between 100° C. and 400° C., wherein the heating step is performed at final pH of between 1.0 And 10.0, wherein the time of oxidation is between 0.5 hr and 10.0 hrs, and wherein the heating step takes place in a vessel capable of withstanding said pressure.

19. A method for oxidative degradation of lignin and polysaccharide fragments dissolved during polyoxometalate treatment of pulp obtained from a non-woody plant, comprising the steps of:

obtaining a pulp from a non-woody plant;

mixing the pulp with a solution of a polyoxometalate of the formula $[V_lMo_mW_nNb_oTa_p(TM)_qX_rO_s]^{x-}$ where l is 0–18, m is 0–40, n is 0–40, o is 0–10, p is 0–10, q is 0–9, r is 0–6, TM is a d-electron-containing transition metal ion, and X is a heteroatom, which is a p or d block element, where $l+m+n+o+p \geqq 4$, $l+m+q>0$ and s is sufficiently large that $x>0$, wherein the pulp is of a consistency of 1–20%, wherein the pulp is delignified, the polyoxometalate is reduced, and the lignin and polysaccharide fragments within the pulp are dissolved, and wherein a liquor is obtained that contains the polyoxometalate and dissolved lignin and polysaccharide fragments, and heating the liquor in the presence of a gaseous oxidant, wherein oxidation takes place, under conditions wherein the polyoxometalate is oxidized and the dissolved lignin and polysaccharide fragments are catalytically and oxidatively degraded by the oxidant and the polyoxometalate to volatile organic compounds and water, wherein the pressure of the oxidant in the heating step is 15 to 1000 psia, wherein the temperature of the heating step is between 100° C. and 400° C., wherein the heating step is performed at final pH of between 1.0 And 10.0, wherein the time of oxidation is between 0.5 hr and 10.0 hrs, and wherein the heating step takes place in a vessel capable of withstanding said pressure.

20. A method for oxidative degradation of lignin and polysaccharide fragments dissolved during polyoxometalate treatment of wood pulp, comprising the steps of:

obtaining a wood pulp;

mixing the wood pulp with a solution of a polyoxometalate of the formula $[V_lMo_mW_n(TM)_oP_5C_pNa_qO_r]^{x-}$, where TM is any d-electron-containing transition metal ion, C is a di- or tri-valent p, d, or f block cation located in the center of the structure, $l+m+n+o=30$, $p+q=1$ and $l+m+o>0$ and r is sufficiently large that $x>0$, wherein the pulp is of a consistency of 1–20%, wherein the pulp is delignified, the polyoxometalate is reduced, and the lignin and polysaccharide fragments within the pulp are dissolved, and wherein a liquor is obtained that contains the polyoxometalate and dissolved lignin and polysaccharide fragments, and heating the liquor in the presence of a gaseous oxidant, wherein oxidation takes place, under conditions wherein the polyoxometalate is oxidized and the dissolved lignin and polysaccharide fragments are catalytically and oxidatively degraded by the oxidant and the polyoxometalate to volatile organic compounds and water, wherein the pressure of the oxidant in the heating step is 15 to 1000 psia, wherein the temperature of the heating step is between 100° C. and 400° C., wherein the heating step is performed at final pH of between 1.0 And 10.0, and wherein the time of oxidation is between 0.5 hr and 10.0 hrs, and wherein the heating step takes place in a vessel capable of withstanding said pressure.

* * * * *